United States Patent [19]

Audet

[11] 4,068,119

[45] Jan. 10, 1978

[54] ELECTRICAL LAMP STAND

[76] Inventor: Germain Audet, 229, rue Lafrance, Albestos, Quebec, Canada

[21] Appl. No.: 685,354

[22] Filed: May 11, 1976

[51] Int. Cl.[2] ..... F21S 1/12; F21S 3/10

[52] U.S. Cl. ..... 362/414; 362/410

[58] Field of Search ..... 240/81 R, 81 BD, 81 A, 240/81 P, 81 C, 81 BS, 82, 83, 84, 81 BC, 81 BA; 248/159

[56] References Cited

U.S. PATENT DOCUMENTS

| | | | |
|---|---|---|---|
| 223,923 | 1/1880 | Kato et al. | 240/83 |
| 3,745,331 | 7/1973 | Dennis | 240/81 BS |

*Primary Examiner*—John Gonzales

[57] ABSTRACT

An electric lamp stand which is made of elongated and longitudinally bored sections and characterized by a connection between two sections which is strong and relatively inexpensive with a connect that acts as a bolt rather than a screw. This electric lamp stand comprises a pair of lamp stand sections, made of wood turnings, each having a bore therethrough and both operatively abutting each other with the bores in endwise alignment and communication. This electric lamp stand distinctively includes a counterbore in one of the lamp stand sections, a first nut pressed in the counterbore, an externally threaded tube having one end screwed in this nut and having the other end extending in the bore of the other lamp stand section, and a second nut screwed on this other end of the tube and with the first nut and tube cooperatively bolting the two lamp stand sections in firm abutment with each other.

3 Claims, 3 Drawing Figures

ELECTRICAL LAMP STAND

This invention relates to electric lamp stands and, more particularly, to electric lamp stands of the type the components of which are sold disassembled to be readily assembled by the buyer. Such lamp stands are generally made of elongated and centrally bored wood turnings which are screwed endwise one against another.

The electric lamp stands of the above type which have been proposed so far and made of wood turnings are joined together by externally threaded wood sleeve connectors that are each operatively screwed into the adjoining ends of two abutting wood turnings. To secure certain parts of the lamp, such as the socket and the base to the wood turning, externally threaded metal sleeves, or tubes, are directly screwed in the wood sleeve connectors (see, for instance, U.S. Pat. No. 3,745,331 to Edward F. Dennis, dated July 10, 1973, entitled: "LAMP STAND CONNECTOR". It has been found that the metal sleeves do not hold in the wood due to the poor grip of their fine thread.

It is a general object of the present invention to provide an electric lamp stand of the above type that obviates the above-mentioned disadvantage.

It is a more specific object of the present invention to provide an electric lamp stand of the above type, wherein a metal sleeve connector acts as a bolt independently of screw threads in the connected members and receives nuts on the opposite ends with one of the nuts adapted for non-rotative accommodation in the central bore of the corresponding lamp stand section.

The above and other objects and advantages of the present invention will be better understood with reference to the following detailed description of preferred embodiments thereof which are illustrated, by way of example, in the accompanying drawings, in which.

Figures 1, 2, 3:
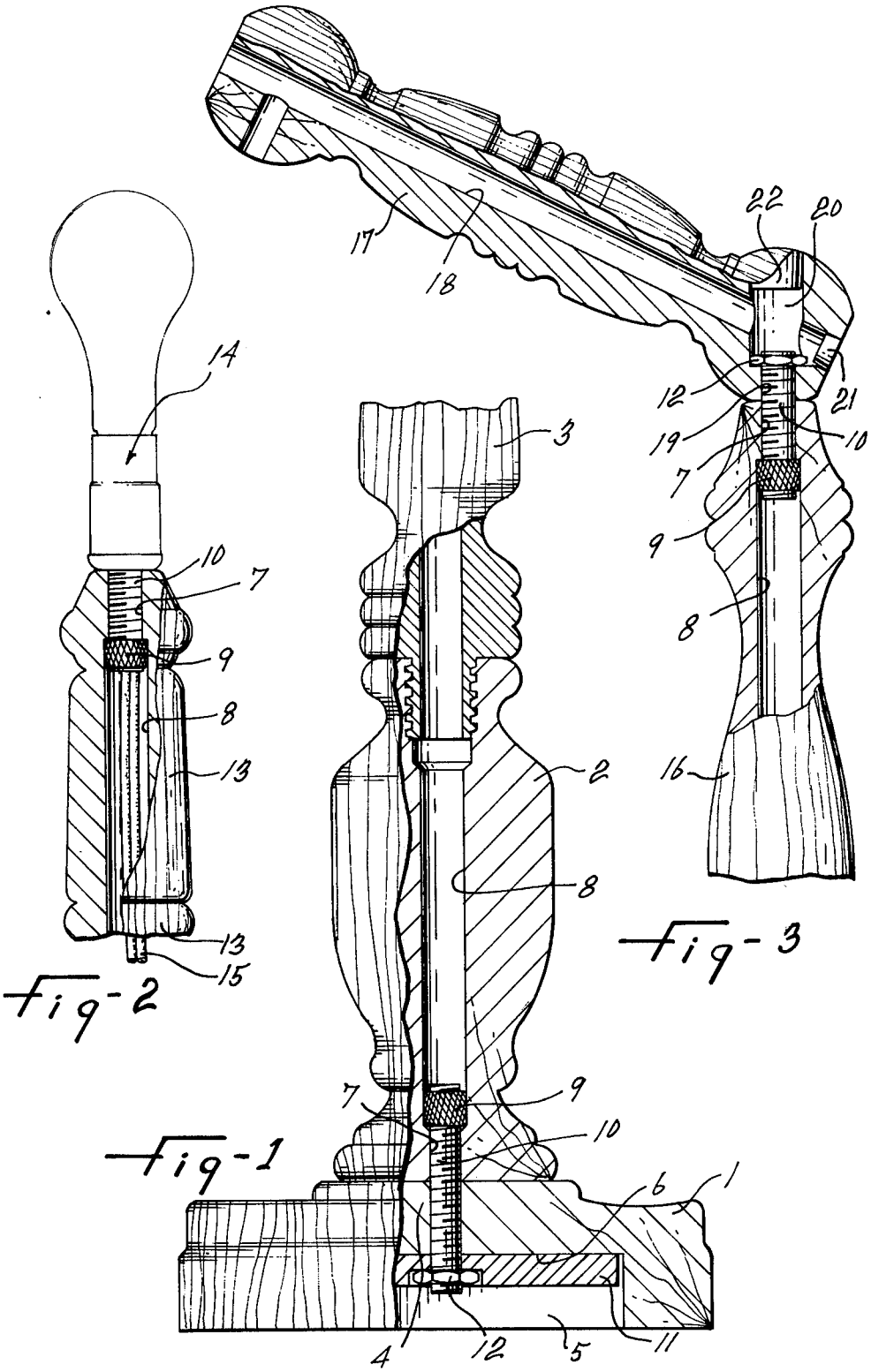
FIG. 1 is an elevation view of the base of a lamp stand according to the present invention and with parts broken away to illustrate the internal structure.
FIG. 2 is an elevation view of the top of a lamp stand according to the present invention and with parts broken away to illustrate the internal structure.
FIG. 3 is an elevation view of an elbow of a lamp stand according to the present invention and with parts broken away to illustrate the internal structure.

The base of the lamp stand illustrated in FIG. 1 comprises a lamp stand base member or section 1, a second lamp stand member or section 2, and a third lamp stand member or section 3. These three lamp stand sections 1, 2, and 3 are made of elongated wood turnings which are longitudinally and centrally bored and in endwise abutment, with the central bores in endwise alignment and communication.

The base 1 is formed with a bore having a portion 4, of predetermined diameter, in communication with the top of the base. The bore at the bottom of the base is counterbored to form a circular cavity 5 and a flat annular shoulder 6 at the junction between bore portion 4 and this cavity.

The second lamp stand section 2 is formed with a bore having a lower portion 7, of the same predetermined diameter as the bore portion 4 of the base 1. The central bore of the lamp stand section 2 is formed with a counterbore portion 8 remote from the base; that is, formed from the top of the lamp stand section.

An externally knurled nut 9 is pressed down in the counterbore portion 8 in non-rotative tight engagement against the annular shoulder formed at the junction between the counterbore portion and the bore portion 7. The knurling on the nut 9 coacts with the deformable wood of the wood turning to non-rotatively retain the nut. An externally threaded tube, or tubular member 10, is inserted in the bore portions 4 and 7 of predetermined diameter and is screwed in the knurled nut 9. A centrally bored flat weight 11 forms an abutment member against the flat annular shoulder 6 in the cavity 5 and is engaged around the lower end of the threaded metal tube 10. A nut 12 is screwed on the lower end of the metal tube 10 and tightens the weight 11 toward the knurled nut 9, and consequently, the two lamp sections 1 and 2 against each other.

The lamp stand of FIG. 1 may be completed by one or more intermediate lamp stand sections 3 and, preferably, by another connection according to the present invention, such as shown in FIG. 2.

In FIG. 2, the lamp stand section 3 supports an upper or top lamp stand section 13. Compared to the lamp stand section 2, the section 13 also includes a central bore extending longitudinally thereof and having a bore portion 7 of predetermined diameter, a counterbore portion 8 and an annular shoulder at the junction between these bore portions 7 and 8. A knurled nut 9 is also press-fitted against the annular shoulder in the lamp stand section 13.

An electric bulb socket 14 is mounted on the upper end of the lamp stand section 13 and is screwed on the upper end of a corresponding externally threaded tube 10. The latter has its lower end screwed in the corresponding knurled nut 9.

The electric cord 15 is threaded down the longitudinal central passage defined by the tube 10 and the counterbore 8 of the section 13, as well as down through every underlying lamp stand section, such as the lamp stand section(s) 3, and the counterbore 8 and the tube 10 of the lamp stand sections 1 and 2.

An electric lamp stand, such as of the bridge type, may be formed with an elbow to laterally offset the electric lamp relative to a table. As shown in FIG. 3, the present invention is also embodied in such elbow. The illustrated lamp stand elbow includes an upright lower lamp stand section 16 and an upper lamp stand section 17 longitudinally extending at an angle to the underlying section 16.

The lamp stand section 16, as section 2 or 13, includes a central bore extending longitudinally thereof and defining a bore portion 7 of predetermined diameter, a counterbore portion 8 and an annular abutment shoulder at the junction between these bore portions. An externally knurled nut 9 is press-fitted in the counterbore 8 against the annular abutment shoulder.

The laterally extending lamp stand section 17 includes a central bore 18, of uniform diameter, extending from end to end thereof. A bore extends transversely through one end of the lamp section 17, at a predetermined angle and in intersection with the longitudinal bore 18. This transverse bore includes a portion 19 of the same predetermined diameter as the bore portion 7, adjacent and in endwise communication with the latter. The transverse bore also includes a counterbore portion 20. The externally threaded tube 10 extends through the bore portion 19 and projects in the counterbore portion 20. A nut 12 is screwed on the end of the tube 10 in the counterbore portion 20 to tighten the lateral arm defined by the lamp section 17 against the upper end of the lamp section 16. A pair of plugs 21 and 22 close the free end of the longitudinal and transverse bores respectively.

It must be noted that the present invention is not to be strictly limited to the specific details of construction which are illustrated and described but also cover other details of construction falling within the scope of the appended claims.

What I claim is:

1. An electric lamp stand comprising, in combination, a first and a second lamp stand members made of wood turnings, each having a cylindrical bore extending therethrough, said first and second lamp stand members operatively abutting each other with said bores in endwise alignment and in communication with each other, the bore of said first lamp stand member having a first cylindrical portion of uniform diameter adjacent said second lamp stand member and a longer counterbore portion remote from the second lamp stand member and cooperatively forming an internal annular abutment shoulder at the junction with said first portion, a cylindrical metal nut having a knurled outer surface of a diameter slightly larger than that of said counterbore portion and pressed through said counterbore portion in frictional engagement with said counterbore portion and in abutment against said internal annular abutment shoulder, so as to be retained against rotation and against axial displacement within said counterbore portion, an externally threaded metal tube freely extending through said first bore portion and freely through the bore of said second lamp stand member and screwed at one end in said cylindrical nut, abutment means including a flat sided metal nut screwed on the other end of said metal tube with said abutment means abutting axially against said second lamp stand member, and electric wires extending through said metal tube and through said counterbore.

2. An electric lamp stand as defined in claim 1, wherein said first lamp stand member constitutes an elongated lamp post section having the bore thereof axially extending lengthwise and centrally thereof, said second lamp stand member constitutes a base having a cavity at the bottom in communication with the bore thereof, a centrally bored flat weight is operatively mounted in said cavity in engagement around the other end of the externally threaded tube, and said flat sided nut on the other end of the threaded metal tube is operatively tightened against the flat weight.

3. An electric lamp stand as defined in claim 1, wherein said first and second lamp stand members constitute a first and a second elongated lamp post section respectively, said second lamp post section has said bore thereof axially extending transversely therethrough, and has another bore axially extending lengthwise and centrally thereof and intercepting the transverse bore thereof, said first elongated lamp post section has the bore thereof axially extending lengthwise and centrally thereof, and a pair of plugs close the outer end of said bore in said second lamp post section and one outer end of said another bore respectively.

* * * * *